US012188180B2

(12) United States Patent
Pauwels et al.

(10) Patent No.: US 12,188,180 B2
(45) Date of Patent: Jan. 7, 2025

(54) PURIFIED MEDICINAL CANNABIS NON-HEMP HURD FIBER, AND ARTICLES CONTAINING THE SAME

(71) Applicants: David Pauwels, Diamond Bar, CA (US); Tiffany Andersen, Diamond Bar, CA (US)

(72) Inventors: David Pauwels, Diamond Bar, CA (US); Tiffany Andersen, Diamond Bar, CA (US)

( * ) Notice: Subject to any disclaimer, the term of this patent is extended or adjusted under 35 U.S.C. 154(b) by 209 days.

(21) Appl. No.: 17/158,956

(22) Filed: Jan. 26, 2021

(65) Prior Publication Data

US 2021/0148046 A1 May 20, 2021

Related U.S. Application Data

(62) Division of application No. 16/280,337, filed on Feb. 20, 2019, now Pat. No. 10,947,668.

(Continued)

(51) Int. Cl.

| | |
|---|---|
| ***D21B 1/02*** | (2006.01) |
| ***D01F 2/00*** | (2006.01) |
| ***D21B 1/04*** | (2006.01) |
| ***D21C 3/02*** | (2006.01) |
| ***D21C 5/00*** | (2006.01) |
| ***D21H 11/12*** | (2006.01) |
| ***D21H 27/00*** | (2006.01) |

(Continued)

(52) U.S. Cl.

CPC ..... *D21H 11/12* (2013.01); *D01F 2/00* (2013.01); *D21B 1/02* (2013.01); *D21B 1/025* (2013.01); *D21B 1/026* (2013.01); *D21B 1/04* (2013.01); *D21C 3/02* (2013.01); *D21C 5/00* (2013.01); *D21C 5/005* (2013.01); *D21H 27/002* (2013.01); *D21H 27/10* (2013.01); *D21J 3/00* (2013.01)

(58) Field of Classification Search

CPC ..... D21H 11/12

See application file for complete search history.

(56) References Cited

U.S. PATENT DOCUMENTS

| | | | |
|---|---|---|---|
| 2,183,869 | A | 12/1939 | Randall et al. |
| 2,244,971 | A | 6/1941 | John |

(Continued)

FOREIGN PATENT DOCUMENTS

| | | | |
|---|---|---|---|
| EP | 0931862 | A1 | 7/1999 |
| KR | 10-2017-0025408 | | 3/2017 |

OTHER PUBLICATIONS

Vega et al., Formosolv fractionation of hemp hurds, Dec. 2016, Industrial Crops and Products, 97, p. 252-259 (Year: 2016).*

(Continued)

*Primary Examiner* — Anthony Calandra

(74) *Attorney, Agent, or Firm* — Bryan Cave Leighton Paisner LLP

(57) ABSTRACT

Provided are purified ozonated medicinal cannabis non-hemp hurd fiber, and refined ozonated medicinal cannabis non-hemp hurd fiber, and compositions containing the ozonated medicinal cannabis non-hemp hurd fiber or refined ozonated medicinal cannabis non-hemp hurd fiber, the compositions including packaging products, molded pulp cartons such as egg cartons, smoking papers, paper packaging materials, single ply or multi-ply paperboard, absorbent paper products, and ink receptive papers.

19 Claims, 2 Drawing Sheets

Related U.S. Application Data

(60) Provisional application No. 62/635,403, filed on Feb. 26, 2018.

(51) Int. Cl.
*D21H 27/10* (2006.01)
*D21J 3/00* (2006.01)

(56) References Cited

U.S. PATENT DOCUMENTS

| | | | |
|---|---|---|---|
| 2,575,422 | A | 11/1951 | Laulainen |
| 3,207,409 | A | 9/1965 | Reifers et al. |
| 3,337,110 | A | 8/1967 | Commisso et al. |
| 3,356,284 | A | 12/1967 | Lake |
| 3,398,875 | A | 8/1968 | Snow et al. |
| 3,954,554 | A | 5/1976 | Curry et al. |
| 4,046,252 | A | 9/1977 | Korby et al. |
| 4,081,123 | A | 3/1978 | Reifers |
| 4,088,259 | A | 5/1978 | Sutton |
| 4,155,384 | A | 5/1979 | Svensson |
| 4,162,769 | A | 7/1979 | Lapointe |
| 4,320,773 | A | 3/1982 | Pinck et al. |
| 4,344,818 | A | 8/1982 | Nuttall et al. |
| 4,500,381 | A | 2/1985 | Nordstrom |
| 4,543,142 | A | 9/1985 | Kuepper et al. |
| 4,617,223 | A | 10/1986 | Hiscock et al. |
| 4,759,967 | A | 7/1988 | Bauermfeind |
| 4,805,678 | A | 2/1989 | Kutilin |
| 4,913,773 | A | 4/1990 | Knudsen et al. |
| 5,005,620 | A | 4/1991 | Morey |
| 5,044,550 | A | 9/1991 | Lamm |
| 5,059,459 | A | 10/1991 | Huffman |
| 5,087,324 | A | 2/1992 | Awofeso et al. |
| 5,205,496 | A | 4/1993 | O'Donnell et al. |
| 5,227,023 | A | 7/1993 | Pounder et al. |
| 5,348,620 | A | 9/1994 | Hermans et al. |
| 5,501,768 | A | 3/1996 | Hermans et al. |
| 5,522,312 | A | 6/1996 | Johnson |
| 5,684,617 | A | 11/1997 | Langhans |
| 5,712,938 | A | 1/1998 | Lin et al. |
| 5,820,565 | A | 10/1998 | McArthur et al. |
| 5,836,242 | A | 11/1998 | Aberg |
| 5,972,456 | A | 10/1999 | Esquivel |
| 6,012,583 | A | 1/2000 | Ramirez |
| 6,164,444 | A | 12/2000 | Bray et al. |
| 6,241,853 | B1 | 6/2001 | Smith et al. |
| 6,305,280 | B1 | 10/2001 | Beckers |
| 6,387,210 | B1 | 5/2002 | Hsu et al. |
| 6,632,013 | B2 | 10/2003 | Wulf et al. |
| 6,669,814 | B2 | 12/2003 | Hansen et al. |
| 6,727,004 | B2 | 4/2004 | Goulet et al. |
| 6,869,505 | B2 | 3/2005 | Lares et al. |
| 6,919,111 | B2 | 7/2005 | Swoboda et al. |
| 6,974,099 | B2 | 12/2005 | Kolar et al. |
| 6,981,795 | B2 | 1/2006 | Nikkah |
| 7,011,258 | B2 | 3/2006 | O'Halloran et al. |
| 7,255,231 | B2 | 8/2007 | Andrews et al. |
| 7,381,300 | B2 | 6/2008 | Skaggs et al. |
| 7,479,511 | B2 | 1/2009 | Laksin et al. |
| 7,612,122 | B2 | 11/2009 | Herlihy et al. |
| 8,034,215 | B2 | 10/2011 | Knobloch et al. |
| 8,197,121 | B2 | 6/2012 | Sands |
| 8,440,054 | B2 | 5/2013 | Svenka et al. |
| 8,444,076 | B2 | 5/2013 | Rukavina |
| 2005/0234152 | A1 | 10/2005 | Ramsey |
| 2008/0027154 | A1 | 1/2008 | Ramsey |
| 2008/0254303 | A1 | 10/2008 | Ramsey |
| 2013/0104915 | A1 | 5/2013 | Eitzinger |
| 2014/0259484 | A1 | 9/2014 | Baer et al. |
| 2016/0130762 | A1 | 5/2016 | Ramaratnam et al. |
| 2017/0101741 | A1 | 4/2017 | Sealey et al. |
| 2020/0308765 | A1* | 10/2020 | Laukkanen ..... C08B 1/00 |

OTHER PUBLICATIONS

Pulping and Bleaching of Hemp by Wong et al., 1995, TAPPI Pulping Conference, p. 471-476 (Year: 1995).*

Sutton et al., Factors Affecting Fiber Characteristics of Pulp [downloaded online https://www.eucalyptus.com.br/artigos/2000_Curl+Kink.pdf on Sep. 7, 2023] (Year: 2000).*

L&W Pulp Tester, 2016, ABB [downloaded online Sep. 7, 2023] (Year: 2016).*

Measurment of wood fiber properties for pulp and paper making, 2023, ABB [downloaded online https://new.abb.com/pulp-paper/abb-in-pulp-and-paper/articles/measurement-of-fiber-properties on Sep. 7, 2023 (Year: 2023).*

Danielewicz et al., Properties and fibre characterisation of bleached hemp, birch and pine pulps: a comparison, 2017, Cellulose, 24, p. 5173-5186 (Year: 2017).*

Dewey et al., "Hemp Hurds as Paper-Making Material," United State Department of Agriculture, Bulletin No. 404 (1916) available on-line as The Project Gutenberg eBook of Hemp Hurds as Paper-Making Material, pp. 1-26, www.gutenberg.org/files/17855/17855-h/17855-h.htm.

Naithani et al., EcoFriendly and Innovative Processing of Hemp Hurds Fibers for Tissue and Towel Paper, 2020, BioResources, 15(1), p. 706-720. (Year: 2020).

Xin et al., Optimization of soda-anthraquinone pulping of Yunma No. 1 hemp hurds and its ECF bleaching, 2008, 2nd International Papermaking and Environment Conference. (Year: 2008).

Smook, Handbook for Pulp and Paper Technologists, 1992, Angus Wilde Publications, 2nd edition, chapters 9 and 13 (Year: 1992).

Bridgeman et al., "Medicinal Cannabis: History, Pharmacology, and Implications for the Acute Care Setting," P&T 42(3): 180-188 (2017).

Smook, Handbook for Pulp and Paper Technologists, 2nd Edition, Angus Wilde Publications Inc., pp. 273-278 and pp. 339-342 (1992).

International Search Report and Written Opinion mailed on Jul. 17, 2019 in PCT/US2019/018723 (14 pages).

* cited by examiner

PURIFIED MEDICINAL CANNABIS NON-HEMP HURD FIBER, AND ARTICLES CONTAINING THE SAME

RELATED APPLICATIONS

This application is a divisional of co-pending allowed U.S. patent application Ser. No. 16/280,337, to David Pauwels and Tiffany Andersen, titled "METHODS FOR PREPARING CANNABIS HURD FIBER, PURIFIED CANNABIS HURD FIBER, AND ARTICLES CONTAINING THE PURIFIED CANNABIS HURD FIBER," filed Feb. 20, 2019, which claims benefit of priority to U.S. Provisional Application No. 62/635,403 to David Pauwels and Tiffany Andersen, titled "METHODS FOR PREPARING CANNABIS HURD FIBER, PURIFIED CANNABIS HURD FIBER, AND ARTICLES CONTAINING THE PURIFIED CANNABIS HURD FIBER," filed Feb. 26, 2018, the subject matter of which is incorporated by reference herein in its entirety.

This application also is related to International PCT Application No. PCT/US2019/018723, filed Feb. 20, 2019, titled "METHODS FOR PREPARING CANNABIS HURD FIBER, PURIFIED CANNABIS HURD FIBER, AND ARTICLES CONTAINING THE PURIFIED CANNABIS HURD FIBER," which also claims priority to U.S. Provisional Application Ser. No. 62/635,403. The subject matter of PCT Application No. PCT/US2019/018723 is incorporated by reference herein in its entirety.

FIELD OF THE INVENTION

The present invention relates to methods for preparing cellulosic fiber from the hurd of cannabis plants, and to products containing the hurd fibers, such as smoking paper and packaging products.

BACKGROUND OF THE INVENTION

In the United States, cannabis plants were conventionally grown for the fiber from its external bark for use in products like rope and clothing, as well as for oilseed and for use as a patent medicine from the mid-19$^{th}$ century. The recreational use of cannabis started in the 1920s during the prohibition of alcohol in the U.S. but such uses were soon banned by many countries in the 1930s. During the 1960s, consuming cannabis was widely used as a form of protest against the government. In 1996, California legalized the use of cannabis for medicinal purposes, and since 2017 almost 30 states in the U.S. have decriminalized possession of small amounts of cannabis, while 8 states have legalized recreational cannabis use (see Bridgeman et al., P & T 42(3): 180-188 (2017)).

As the demand for medical and recreational cannabis continues to grow, larger crops of cannabis are being cultivated and harvested. The cannabis stalk includes an inner layer of core fiber, referred to as the hurd, and an outer layer surrounding the hurd referred to as the bast. The bast is harvested in hemp crops for its long tough fibers. For cannabis grown for medicinal and recreational purposes, the stalk of the plant is a waste product. Even for hemp harvested for fiber, the hurd is considered a waste product. The largest uses for hemp hurd include animal bedding, mulch and acoustic tiles. Accordingly, a new innovative use of the hurd fibers of cannabis is needed as the amount of cannabis stalk material increases.

SUMMARY OF THE INVENTION

The present invention is directed to methods of preparing cellulosic fiber from cannabis hurd that substantially obviates one or more of the problems due to limitations and disadvantages of the related art.

An object of the present invention is to provide a method of manufacturing cellulosic fiber using the hurd of cannabis stalks, including stalks from cannabis grown for medicinal purposes. The process includes treatment with ozonated water and eliminating halogen bleaching, resulting in a more natural product free of any halogenated by-products.

Another object of the present invention is to provide isolated purified cannabis hurd fibers. The isolated purified cannabis hurd fiber is oxidized, by treatment with ozonated water and exposure to electromagnetic radiation. The isolated purified cannabis hurd fiber can contain little or no pectin. The isolated purified cannabis hurd fiber can have: an arithmetic mean fiber length of from about 0.15 mm to about 0.75 mm; or an average fiber width of from about 23 μm to about 30 μm; or a curl of at least 5%; or an average kink angle of about 133°; or any combination thereof. The isolated purified cannabis hurd fiber can have a pale yellow color or can be off white to white.

Another object of the present invention is to provide a use for cannabis hurd fibers when only hurd fibers are used as the cellulosic fiber for the manufacture of smoking paper products.

Another object of the present invention is to provide a use for cannabis hurd fibers, alone or in combination with cannabis bast fiber or wood fiber or combinations thereof, such as for the manufacture of paper packaging products.

Another object of the present invention is to provide a use for cannabis hurd fibers, alone or in combination with softwood fiber or hardwood fiber or combinations thereof, such as for the manufacture of absorbent paper products, including paper towels and toilet paper.

Another object of the present invention is to provide a use for cannabis hurd fibers, alone or in combination with one or more additional fibers, such as cannabis bast fiber, softwood fiber, hardwood fiber, cotton fiber, linen fibers or combinations thereof, such as for the manufacture of an ink receptive, such as writing paper, copying paper, labels and label stock, text paper, cover paper, magazine and newsprint paper, and tag paper.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, provided herein are methods for preparing cellulose fiber from cannabis hurd. The methods include a decorticating step to remove the outer bast from the hurd of cannabis stalk; exposing the hurd to synthetic sunlight to produce a bleached hurd; exposing the bleached hurd to a fibrillation step to at least partially fibrillate the hurd into fibrils to form a fibrillated hurd fiber; abiotically retting the fibrillated hurd fiber to remove pectin to yield an abiotically retted hurd fiber; exposing the abiotically retted hurd fiber to ozone or ozonated water, alone or in combination with synthetic sunlight, to yield a treated hurd fiber; and refining the treated hurd fiber to produce a refined hurd fiber. The decorticating step can include exposing the cannabis stalk to a mechanical, manual, hydraulic or pneumatic process that removes the bast from the hurd. For example, the decorticating step can include removing the bast using a mechanical stripper, or a mechanical debarking apparatus, or decorticating equipment, or can include removing the bast using one or more jets of high pressure air or high pressure water. When jets of water are used, the water can be ozonated. The decorticating step also can include soaking the cannabis stalks in deionized, distilled or ozonated water prior to decorticating.

The length of time the hurd is exposed to synthetic sunlight in the methods provided herein is at least 300 hours. The hurd can be exposed to synthetic sunlight for a period of time from about 300 hours to about 480 hours. The hurd can be exposed to synthetic sunlight for a period of time from about 336 hours to about 408 hours. The hurd can be exposed to synthetic sunlight for 300 hours, or 312 hours, or 324 hours, or 336 hours, or 348 hours, or 360 hours, or 372 hours, or 384 hours, or 396 hours, or 408 hours, or 420 hours, or 432 hours, or 444 hours, or 456 hours, or 468 hours, or 480 hours. Exposure to the synthetic sunlight can promote oxidation of the chemicals in the hurd, particularly the lignin or lignin-like compounds.

For processing, the cannabis stalks can be reduced in size, e.g., to produce particles having a length of 10 cm or less prior to fibrillation. The length can be from about 1 cm to about 10 cm, or from about 1 cm to about 5 cm, or from about 5 cm to about 10 cm, or from about 2 cm to about 8 cm. Fibrillation can be achieved by passing the hurd through a mechanical chipper or shredder. After fibrillation, where at least a portion of the fibers have been separated into fibrils, the fibers are subjected to an abiotic retting process that can include treating the hurd fiber with an alkalizing agent in aqueous solution at an elevated temperature. The alkalizing agent can be selected from among sodium carbonate, sodium bicarbonate, potassium carbonate, potassium bicarbonate, sodium hydroxide, potassium hydroxide, and combinations thereof. In some methods, the alkalizing agent includes sodium carbonate. The alkalizing agent can be present in an amount from about 0.5% to about 10% by weight based on the weight of the fibers. The abiotic retting can be performed for a period of time from about 0.5 to about 8 hours with occasional or constant mixing. The abiotic retting can be performed at a temperature from about 40° C. to about 110° C., or from 50° C. to about 105° C. The abiotic retting is terminated by washing with water to remove the alkalizing agent, such as washing with water until the pH becomes more acidic. For example, the washing with water can be performed until the pH is reduced to about 8 or less yielding a washed fiber.

In the methods provided herein, the washed fiber can be treated with an enzyme, such as a pectinase or a ligninase or a combination thereof. The pectinase can be selected from among pectin esterase, pectin trans-eliminase, pectate lyase, an endo-polygalacturonase, an exo-polygalacturonase and combinations thereof. The ligninase can include a laccase, a lignin lyase, a lignin peroxidase, or a combination thereof.

After washing or abiotically retting the hurd fiber, the fiber can be exposed to natural sunlight under ambient environmental conditions. The hurd fibers can be positioned on a reflective surface that reflects the natural sunlight into the hurd fibers to increase fiber exposure to the natural sunlight. The hurd fibers can be maintained in a circulating vat or tray that promotes circulation of the slurry across the surface of the tray or vat, providing mixing and exposure of different surfaces of the fiber to the natural sunlight striking and illuminating the surface. The natural sunlight exposure can be combined with exposure to ozone or ozonated water. The tray or vat can include inlets for injecting ozone into the slurry periodically to maintain a high level of ozone in the slurry while the slurry is exposed to the natural sunlight. The level of ozone in the slurry can be at least 25 μg/mL, or 50 μg/mL, or at least 55 μg/mL, or at least 60 μg/mL, or at least 65 μg/mL, or at least 70 μg/mL, or at least 75 μg/mL. The level of ozone in the slurry can be from at or about 50 μg/mL to at or about 100 μg/mL. The level of ozone in the slurry can be from at or about 65 μg/mL to at or about 80 μg/mL.

After washing or abiotically retting the hurd fiber, the fiber can be exposed to ozone or ozonated water for a time period of from 1 hr to 100 hrs. The ozone exposure or ozonated water exposure can be combined with exposure to synthetic sunlight. The hurd fibers can be positioned on a reflective surface that reflects the synthetic sunlight into the hurd fibers to increase fiber exposure to the synthetic sunlight. The hurd fibers can be maintained in a circulating vat or tray that promotes circulation of the slurry across the surface of the tray or vat, providing mixing and exposure of different surfaces of the fiber to the synthetic sunlight striking and illuminating the surface. The tray or vat can include inlets for injecting ozone into the slurry periodically to maintain a high level of ozone in the slurry while the slurry is exposed to the light. The level of ozone in the slurry can be at least 25 μg/mL, or 50 μg/mL, or at least 55 μg/mL, or at least 60 μg/mL, or at least 65 μg/mL, or at least 70 μg/mL, or at least 75 μg/mL. The level of ozone in the slurry can be from at or about 50 μg/mL to at or about 100 μg/mL. The level of ozone in the slurry can be from at or about 65 μg/mL to at or about 80 μg/mL.

The exposure of the fibers to synthetic sunlight can be performed at a temperature of from about 20° C. to 50° C. The exposure of the fibers to synthetic sunlight can be performed at a temperature of from about 23° C. to 30° C. The fibers can be exposed to the synthetic sunlight for a time of up to about 780 hours, or up to about 756 hours, or up to about 732 hours, or up to about 720 hours. The fibers can be exposed to the synthetic sunlight for a time period of from about 300 hours to about 780 hours, or a time period of from about 312 hours to about 768 hours, or a time period of from about 324 hours to about 756 hours, or a time period of from about 336 hours to about 744 hours, or a time period of from about 336 hours to about 720 hours.

The purified hurd fibers can have an arithmetic mean fiber length of from about 0.15 mm to about 0.75 mm. The purified hurd fibers can have an arithmetic mean fiber length of from about 0.35 mm to about 0.65 mm. The purified hurd fibers can have a mean fiber length weighted in length of from about 0.6 mm to about 0.7 mm The purified hurd fibers can have an average fiber width of from about 23 μm to about 30 μm.

Also provided are methods of preparing a refined cannabis hurd fiber. The methods include dispersing the purified cannabis hurd fibers prepared as described above in water to form a slurry in a hydro-pulper, and refining the fibers. The refining can be accomplished by exposing the fibers to mechanical energy using a Hollander beater, a conflo refiner, a conical refiner, a disc refiner, a double disc refiner, a British disintegrator, an angle disintegrator, a blender, a homogenizer, a microfluidizer, or any combination thereof. The refining can include a thermo-mechanical refining process that includes refining at an elevated temperature and an elevated pressure. For example, refining can be performed at a temperature of at least 150° C., such as a temperature from about 160° C. to about 185° C. The pressure can be from about 2 bars to about 16 bars. In the refining step, the mechanical energy can impart an energy intensity in the range of from about 20 to about 120 kWh/ton of fiber. Refining the cannabis hurd fiber and dispersing the fiber in water can form a pulp having a Canadian standard freeness of about 500 mL or less, or from about 475 mL or less. The cannabis hurd fiber slurry can be prepared to have a consistency of about 1.6% or less, or about 1.55% or less. Consistency can be measured using TAPPI T 240 om-12—Consistency standard test method. The cannabis hurd fiber can have a coarseness (average weight of fiber per unit length) of from about 0.195 to about 0.285 mg/m.

Also provided herein is a cellulosic smoking paper that contains the purified cannabis hurd fibers or the refined cannabis hurd fibers prepared as described above. The smoking paper can have a basis weight of from about 15 to about 90 g/m$^2$. The smoking paper can have a basis weight of from about 18 g/m$^2$ to about 40 g/m$^2$, or from about 25 g/m$^2$ to about 50 g/m$^2$, or from about 45 to about 75 g/m$^2$. The smoking paper can have a basis weight of from about 3 pounds/ream to about 5 pounds/ream, or from about 3.25 pounds per ream to about 4.5 pounds/ream. The smoking paper can contain only purified cannabis hurd fiber or refined cannabis hurd fiber or a combination thereof as the cellulosic fiber in the smoking paper. The smoking paper can include purified cannabis hurd fiber or refined cannabis hurd fiber in combination with cannabis bast fiber, or a wood fiber, or a combination thereof.

The smoking paper provided herein can include a filler, an additive, a coating or any combination thereof. The filler can be selected from among a starch, a dextrin, a maltodextrin, gum arabic, calcium carbonate, magnesium carbonate, clay, calcined clay, kaolin, titanium oxide, and a combination thereof. When present, the filler can be present in an amount of from about 2.5 wt % to about 60 wt % based on the overall weight of the smoking paper.

The smoking paper provided herein can include a burn rate modifier. The burn rate modifier can be a sodium or potassium salt of a naturally occurring fruit acid. The fruit acid can be selected from among citric acid, maleic acid, tartaric acid, gluconic acid, fumaric acid and succinic acid and combinations thereof. In some applications, the burn rate modifier can be a sodium citrate or a sodium succinate or a combination thereof. When present, the burn rate modifier can be present in an amount of from about 0.5 wt % to less than 10 wt % based on the overall weight of the smoking paper.

The smoking paper provided herein can include a coating. The coating can include a film forming polymer. The film forming polymer can be a starch, gum arabic, carboxymethyl cellulose or any combination thereof. When present, the film forming polymer can be present in an amount of from about 0.1 wt % to about 5 wt % based on the overall weight of the smoking paper. The smoking paper can be formulated to include a calcium carbonate content from about 1.5 wt % to about 25wt % and a burn rate modifier in an amount of from about 0.5 wt % to about 2.5 wt %.

The smoking papers provided herein can include a watermark. The watermark can be designed or positioned to modulate the burn rate of the paper. For example, the watermark can include a repeating pattern that, when rolled to form a smoking article, results in the formation of a series of rings about the circumference of the smoking article along the length of the smoking article. The watermark can produce areas of increased and decreased fiber concentrations in the paper, and the repeating pattern about the circumference of the smoking article can promote a circular burn pattern during use of the smoking article. The watermark can minimize or prevent uneven burning or canoeing of the paper of the smoking article during use.

The smoking paper can a have a moisture content in the range of from about 1% to about 10% based of the weight of the paper. The smoking paper can a have a moisture content in the range of from about 6% to about 9% based of the weight of the paper. The smoking paper can have a permeability of from about 2 to about 45 cubic centimeters per minute ($cm^3 \cdot min^{-1}$). The smoking paper can be calendared to have a smooth surface.

Also provided are methods of making a smoking paper that contains a cannabis hurd fiber. The methods include preparing an aqueous slurry of the refined cannabis hurd fiber; depositing the slurry on the wire of a papermaking machine or a hand papermaking apparatus; removing the water from the slurry to form a raw paper material; and drying the raw paper material to form the smoking paper. The method also can include adding a filler to the slurry prior to depositing the slurry on the wire. The filler can be selected from among a starch, a dextrin, a maltodextrin, gum arabic, calcium carbonate, magnesium carbonate, clay, calcined clay, kaolin, titanium oxide, and a combination thereof. When present, the filler can be present in an amount of from about 2.5 wt % to about 60 wt % based on the overall weight of the smoking paper.

The method also can include applying an additive or a film forming polymer on a surface of the raw paper material prior to drying. The applying of the additive or the film forming polymer can be accomplished by preparing an aqueous solution containing the additive or the film forming polymer; and applying the aqueous solution to the surface of the raw paper material.

The method also can include pressing the raw paper material to remove additional water prior to drying. The pressing can be accomplished by passing the raw paper through a nip formed between two rollers, the rollers exerting a pressure on the raw paper to force water from the material. The pressure can be in a range of from about 100 psi to about 800 psi. In the methods for preparing the paper, the drying of the raw paper material can be accomplished by exposure of the raw paper material to infrared irradiation, or to hot air streams, or by generating thermal energy in the wet web structure using microwave radiation, or by contact with hot dryer cans, or any combination thereof. The drying can be performed at a temperature in the range of from about 25° C. to 160° C., or in the range of 25° C. to about 90° C., or in the range of from about 25° C. to about 40° C., or in the range of from about 25° C. to about 30° C. Drying can be performed until a moisture in the paper is in a range of from about 1% to about 10% of the weight of the paper. Drying can be performed until a moisture in the paper is in a range of from about 6% to about 9% of the weight of the paper. Drying can be performed until a moisture in the paper is in a range of from about 6.4% to about 8.4% of the weight of the paper. The addition of an additive or a film forming polymer or any combination thereof alternatively can be performed after application of pressure to the raw paper material prior to drying.

The smoking papers containing the cannabis hurd fiber also can be calendared. The calendaring can be performed at a pressure in a calendaring nip of from about 0.5 to about 15 MPa. The calendaring can be performed at a temperature at the calendaring nip in a calendaring nip in the range of about 120° C. to about 250° C. Once prepared, the smoking paper can be cut to the desired or target dimension or size.

Also provided are packaging products that contain the purified cannabis hurd fibers or the refined cannabis hurd fibers provided herein or a combination thereof. Provided is a paper packaging material that can contain a paper substrate containing at least about 40% the purified cannabis hurd fibers or the refined cannabis hurd fibers provided herein or a combination thereof, and having an inner surface and an outer surface; and a moisture barrier layer comprising one or more energy-cured polymers positioned over the outer surface, where the packaging material has a water vapor transportation rate of about 500 $g/m^2$/day or less. The paper substrate of the packaging material can include from about 5 to about 60% softwood fibers, and from about 5 to about 60% hardwood fibers, or a combination of hardwood and softwood fibers. The softwood fibers or the hardwood fibers or both can be recycled fibers or recyclable fibers. The paper substrate can have a basis weight of from about 25 pounds/3300 square feet to about 120 pounds/3300 square feet and a caliper of from about 2 mils to about 5 mils.

The packaging product can be a molded pulp carton, such as an egg carton. The molded pulp carton, such as an egg carton, can include at least 40 wt % of the purified cannabis hurd fibers provided herein. The molded pulp carton can include 100 wt % purified cannabis hurd fibers provided herein. The molded pulp carton can include from about 5 to about 60 wt % softwood fibers, or from about 5 to about 60 wt % hardwood fibers, or from about 5 to 55 wt % softwood fibers and from about 5 to 55 wt % hardwood fibers. The softwood fibers or the hardwood fibers or both can be recycled fibers or recyclable fibers. The purified cannabis hurd fibers can have: an arithmetic mean fiber length of from about 0.15 mm to about 0.75 mm, or an average fiber width of from about 23 μm to about 30 μm, or a curl of at least 5%, or an average kink angle of about 133° or any combination thereof.

In the paper packaging material provided herein, the energy-cured polymers of the moisture barrier layer can be formed by curing one or more energy-curable monomers selected from among dipropylene glycol diacrylate; tripropylene glycol diacrylate; butanediol diacrylate; hexanediol diacrylate; alkoxylated hexanediol diacrylate; trimethyol propane triacrylate; alkoxylated trimethylol propane triacrylate; di(trimethylol propane triacrylate); glycerolpropoxy triacrylate; pentaerythritrol triacrylate; alkoxylated pentaerythritrol triacrylate; di(pentaerythritrol triacrylate); neopentaglycol diacrylate; alkoxylated neopentaglycol diacrylate; dipropylene glycol dimethacrylate; tripropylene glycol dimethacrylate; butanediol dimethacrylate; hexanediol dimethacrylate; alkoxylated hexanediol dimethacrylate; trimethyol propane trimethacrylate; alkoxylated trimethylol propane trimethacrylate; di(trimethylol propane methtriacrylate); glycerolpropoxy trimethacrylate; pentaerythritrol trimethacrylate; alkoxylated pentaerythritrol trimethacrylate; di(penta-erythritrol trimethacrylate); neopentaglycol dimethacrylate; alkoxylated neopentaglycol dimethacrylate; acrylated epoxy resins; bis acrylic esters of bisphenol A; acrylated polyurethanes; acrylated polyesters; and acrylated polyethers. The energy-cured polymers can be formed by curing one or more energy-curable monomers selected from among urethane acrylates, aliphatic urethane acrylates, aliphatic urethane triacrylate/monomer blends, aliphatic urethane triacrylates blended with 1,6-hexanediol acrylates, hexafunctional urethane acrylates, siliconized urethane acrylates, aliphatic siliconized urethane acrylates, polyether acrylates, trimethylolpropane triacrylates, 2-phenoxyethyl acrylates, isobornyl acrylates, propoxylated glyceryl triacrylates, acrylate ester derivatives, methacrylate ester derivatives, acrylate ester derivatives, or tripropylene glycol diacrylate. In the paper packaging materials provided herein, the moisture barrier layer can be provided at a coat weight of from about 1 $g/m^2$ to about 10 $g/m^2$.

Also provided are cellulosic single ply or multi-ply paperboards containing the purified cannabis hurd fibers or the refined cannabis hurd fibers provided herein, or a combination thereof.

Also provided are absorbent paper products that contain the purified cannabis hurd fibers or the refined cannabis hurd fibers provided herein. Example of absorbent paper products include a paper towel, a tissue, a napkin and sanitary paper or toilet paper. The purified cannabis hurd fibers or the refined cannabis hurd fibers provided herein or a combination thereof can be the only cellulosic fiber present. For applications other than toilet paper, the absorbent paper product can include other fibers, such as a softwood fiber, a hardwood fiber, a cannabis bast fiber and combinations thereof. For toilet paper, no cannabis bast fiber or hemp bast fiber is included in the toilet paper. The toilet paper can include other fibers, such as a softwood fiber, a hardwood fiber, or combinations thereof.

Also provided are ink receptive papers that contain the purified cannabis hurd fibers or the refined cannabis hurd fibers provided herein. In some ink receptive papers, the purified cannabis hurd fibers or the refined cannabis hurd fibers provided herein or a combination thereof is the only cellulosic fiber present. The ink receptive paper can include one or more additional fibers, such as a cannabis bast fiber, a hemp bast fiber, a hemp hurd fiber, a softwood fiber, a hardwood fiber, a cotton fiber, a linen fibers or a combination thereof. Examples of ink receptive papers include a writing paper, a copying paper, a label, a text paper, a cover paper, a magazine paper, a newsprint paper, and a tag paper.

It is to be understood that both the foregoing general description and the following detailed description are exemplary and explanatory and are intended to provide further explanation of the invention as claimed.

DETAILED DESCRIPTION

The headings used herein are for organizational purposes only and are not meant to limit the scope of the description or the claims in any way.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. The drawings described herein are for illustrative purposes only of selected embodiments and not all possible implementations, and are not intended to limit the scope of the present disclosure.

In the drawings.

DEFINITIONS

Figure 1:
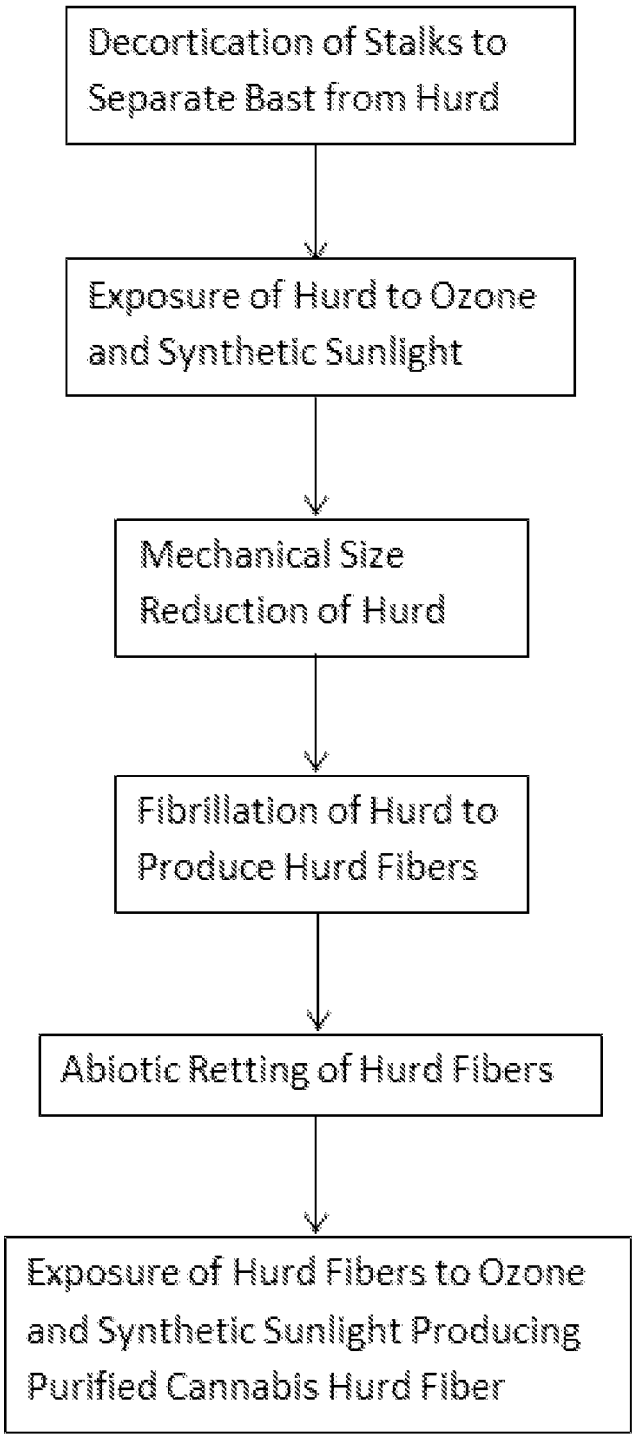
FIG. 1 illustrates an exemplary cannabis stalk processing process that yields purified cellulosic fiber from the hurd of the cannabis stalk.

Unless defined otherwise, all technical and scientific terms used herein have the same meaning as is commonly understood by one of skill in the art to which the inventions belong.

All patents, patent applications, published applications and publications, websites and other published materials referred to throughout the entire disclosure herein, unless noted otherwise, are incorporated by reference in their entirety. Where reference is made to a URL or other such identifier or address, it is understood that such identifiers can change and particular information on the internet can come and go, but equivalent information can be found by searching the internet. Reference thereto evidences the availability and public dissemination of such information.

In the event that there are a plurality of definitions for terms herein, those in this section prevail.

As used here, the singular forms "a," "an" and "the" include plural referents unless the context clearly dictates otherwise.

As used herein, ranges and amounts can be expressed as "about" a particular value or range. "About" also includes the exact amount. Hence "about 5 percent" means "about 5 percent" and also "5 percent." "About" means within typical experimental error for the application or purpose intended.

As used herein, "optional" or "optionally" means that the subsequently described element, event or circumstance does or does not occur, and that the description includes instances where the element, event or circumstance occurs and instances where it does not. For example, an optional component in a formulation means that the component may be present or may not be present in the formulation.

In the examples, and throughout this disclosure, all parts and percentages are by weight (wt %) and all temperatures are in ° C., unless otherwise indicated.

As used herein, the phrase "based on the weight of the composition" with reference to % refers to wt % (mass% or (w/w)%).

As used herein, "cannabis" refers to any of the plants belonging to the family Cannabaceae, and includes species such as sativa, indica, and ruderalis, or any portion of the plant, such as stalks or stems.

As used herein, "hurd" refers to the inner portion or core of the cannabis plant stem or stalk.

As used herein, "bast" refers to the fibrous outer portion of the cannabis plant stem or stalk.

As used herein, "abiotic retting" and "abiotically retting" refers to dissolving or removing or both the pectin from a plant material without the use of living microorganisms. Abiotic retting can include treatment with an alkalizing agent or a pectinase enzyme or a combination thereof.

As used herein, "purified hurd fiber" refers to hurd fiber substantially free of bast fiber, where the hurd fiber has been subjected to at least an abiotic retting process, such as treatment with an alkalizing agent, and treatment with ozone to produce a cellulosic fiber product. The purified fiber contains little to no pectin.

As used herein, "ozonated water" refers to water through which ozone has been bubbled. The ozone can be produced, e.g., using an ozone generator.

As used herein, "synthetic sunlight" refers to use of a light source to provide illumination that approximates natural sunlight. An exemplary light source is a high pressure sodium lamp, alone or in combination with a xenon arc lamp, a metal halide arc lamp, light-emitting diodes, and combinations thereof.

As used herein, a "fruit acid" refers to any carboxylic acid from a fruit source. Examples include citric acid, maleic acid, tartaric acid, gluconic acid, fumaric acid and succinic acid and combinations thereof.

As used herein, "packaging material" refers to materials for forming packages for protecting, carrying, or distributing products. Packaging material may include, for example, wraps, containers (e.g., for foods or beverages), boxes, cartons and canisters.

As used herein, "calendered" refers to a material that has been subjected to calendering, which can smooth out the material for improving printing on the material, or to increase the smoothness or gloss of the material surface. Calendering generally involves a process of using pressure (and optionally temperature and moisture) for imparting a smooth surface on a rough paper material surface. Calendering can be carried out on a calender, which can include a series of calender rolls, and can be performed on-line (at the end of a papermaking machine), or off-line (separate from the papermaking machine). Calendering can include belt calendering, extended nip calendering, show calendaring, hot-soft calendering, moisture-gradient calendering, or supercalendering. (See Smook, *Handbook for Pulp and Paper Technologists* ($2^{nd}$ Edition, 1992), pages 273-278, for a general description of calendering, as well as devices for carrying out calendering).

As used herein, "energy-curable coating" refers to a coating that includes at least one energy-cured polymer, or energy-curable monomers for forming the energy-cured polymers. These energy-curable coatings (or energy-curable coating compositions used to provide such coatings) can include other optional additives, such as, e.g., diluents, dispersants, pigments, rheology modifiers, solvents, and surfactants. The energy-curable coating compositions can be formulated to be in a form of an aqueous slurry, an aqueous solution, a non-aqueous solution, a non-aqueous slurry, a colloidal suspension, an emulsion, or a liquid mixture.

As used herein, "energy-curable monomers" refers to monomers or oligomers that are crosslinkable or polymerizable when exposed to an energy source, such as a radiation source, including heat and light, yielding energy-cured polymers. Exemplary energy-curable monomers include acrylated epoxy resins; acrylated polyurethanes; acrylated polyesters; acrylated polyethers; alkoxylated hexanediol dimethacrylate; alkoxylated neopentaglycol dimethacrylate; bis acrylic esters of bisphenol A (such as di-3-(methacryloxy-2-hydroxypropyl) ether of bisphenol-A); butanediol diacrylate; butanediol dimethacrylate; dipropylene glycol diacrylate; tripropylene glycol diacrylate; hexanediol diacrylate; alkoxylated hexanediol diacrylate; trimethyol propane triacrylate; alkoxylated trimethylol propane triacrylate; di(trimethylol propane triacrylate); glycerolpropoxy triacrylate; pentaerythritrol triacrylate; alkoxylated pentaerythritrol triacrylate; di(penta-erythritrol triacrylate); neopentaglycol diacrylate; alkoxylated neopentaglycol diacrylate; dipropylene glycol dimethacrylate; tripropylene glycol dimethacrylate; hexanediol dimethacrylate; trimethyol propane trimethacrylate; alkoxylated trimethylol propane trimethacrylate; di(trimethylol propane methtriacrylate); glycerolpropoxy trimethacrylate; pentaerythritrol trimethacrylate; alkoxylated pentaerythritrol trimethacrylate; di(penta-erythritrol trimethacrylate); neopentaglycol dimethacrylate di(2-methacryloxy ethyl ether of bisphenol-A; di-(3-acryloxy-2-hydroxypropyl ether of bisphenol-A; urethane acrylates; aliphatic urethane acrylates; aliphatic urethane triacrylate/monomer blends; aliphatic urethane triacrylates blended with 1,6-hexanediol acrylates; hexafunctional urethane acrylates; siliconized urethane acrylates; aliphatic siliconized urethane acrylates; polyether acrylates; trimethylolpropane triacrylates; 2-phenoxyethyl acrylates; isobornyl acrylates; propoxylated glyceryl triacrylates; acrylate ester derivatives; methacrylate ester derivatives; acrylate ester derivatives; and tripropylene glycol diacrylate. See also U.S.

Pat. No. 7,479,511 (Laksin et al., 2009) and U.S. Pat. No. 7,612,122 (Herlihy, 2009); and U.S. Pub. Appl. Nos. 20050234152 (Ramsey, 2005); 20080027154 (Ramsey, 2008); and 20080254303 (Ramsey, 2008).

As used herein, "Parker Print Smoothness" refers to the extent to which the paper surface deviates from a planar or substantially planar surface, as affected by the depth of the paper, paper width, or numbers of departure from that planar surface, as measured by TAPPI test method T 555 om-99 at a clamping pressure of 10 kgf/cm$^2$. Parker Print Smoothness values reflect the degree of "microroughness" of the substrate or coating surface. The higher the Parker Print Smoothness value, the rougher the substrate, layer, or coating surface. Conversely, the lower Parker Print Smoothness value, the smoother the substrate, layer, or coating surface.

As used herein, "moisture barrier layer" refers to a layer that is protective against environmental moisture, i.e., a layer that has a relatively low water vapor transmission rate, especially in environments having a relatively high relative humidity (RH) (e.g., about 65% or greater, or about 80% or greater). The moisture barrier layer can be a single layer, or can include a plurality of layers.

As used herein, "water vapor transmission rate" (WVTR) refers to the rate at which water vapor or moisture passes through or is transmitted through a material, layer, or substrate, typically expressed in units of g/m$^2$/day. WVTR can be measured by TAPPI method T464 om-90.

As used herein, "basis weight" refers to the grammage of a sheet of the paper substrate, with or without a coating layer, as determined by TAPPI test T410. See G. A. Smook, *Handbook for Pulp and Paper Technologists* (2$^{nd}$ Edition, 1992), pages 339-342, which describes the physical test for measuring basis weight.

As used herein, a "mil" refers to a unit of measure equal to 0.001 of an inch (0.0254 mm), typically used to describe a thickness of a material sold in sheets.

Reference will now be made in detail to an embodiment of the present invention, an example of which is illustrated in the accompanying drawings.

Methods for Producing Hurd Cellulosic Fiber From Cannabis Stalks

Cannabis grown for fiber (hemp) exhibits significantly different structural properties of the plant, including thickness of the stalk, branching and leafing, compared to cannabis grown for medicinal or recreational purposes. For example, hemp grown for collection of the bast fiber typically is planted and grown at high density to increase the ratio of bast to hurd and to produce non-branched plants (see Canadian Hemp Trade Alliance (2017), available at www.hemptrade.ca/eguide/fibre-production/types-of-hemp-fibre). Bast fiber content increases with increasing plant density. In contrast, medicinal and recreational cannabis is grown at lower density to promote flowering and bud formation. This lower density results in formation of a plant with a much lower ratio of bast to hurd, and also promotes branching of the plants.

An exemplary method for producing cannabis hurd fiber is shown in the flow chart of FIG. 1. The method includes decortication of the cannabis stalks to separate and remove the bast (outer fiber) from the hurd (inner fiber core). The hurd then is exposed to natural sunlight or synthetic sunlight or a combination thereof, and optionally ozone. The method also includes mechanical size reduction of the hurd, followed by fibrillation of the hurd to produce cannabis hurd fibers. The hurd fibers then are subject to an abiotic retting. The abiotic retting includes exposure to an alkalizing agent, an optionally exposure to one or more enzymes. For example, the fibers can be exposed to pectinase or ligninase enzymes, or combinations thereof. After the abiotic retting process, the cannabis hurd fibers is exposed to natural sunlight or synthetic sunlight or a combination thereof, and optionally ozone, producing a purified cannabis hurd fiber. This fiber can be refined and used for the manufacture of paper products, such as smoking paper and packaging materials.

The methods provided herein begin with collection of the cannabis stalks. The stalks can be collected directly following removal of the buds, or they can be allowed to dry somewhat in the field prior to collection.

A first step for processing is the separation of the bast from the hurd. The bast can be removed using mechanical, manual, hydraulic or pneumatic processes. For example, mechanical strippers, or debarking or decorticating equipment can be used or modified for use with the cannabis stalks (see, e.g., U.S. Pat. No. 2,244,971 (St. John, 1941); U.S. Pat. No. 2,575,422 (Laulainen, 1951); and U.S. Pat. No. 4,805,678 (Kutilin, 1989)). Such equipment strips away the bast from the hurd, or abrades the bast to remove it from the hurd.

Jets of high pressure air or water also can be used to remove the bast from the hurd. The stalks can be soaked in distilled or an ozonated water prior to subjecting the stalks to high pressure air or water jets. In an exemplary application, the stalks are soaked in distilled or an ozonated water for up to five days prior to stripping the bast from the hurd using high pressure air or water jets. For example, after soaking in distilled water for 5 days, the stalks are placed between stainless steel screens for support and subjected to jets of water at a pressure of 3200 psi to remove the bast from the hurd. The stalks can be repositioned between the screens during treatment to insure that all of the bast is removed from the hurd by exposure to the high pressure jets of water. In some applications, a combination of jets of high pressure air and high pressure water is used to remove the bast from the hurd. The water used in the high pressure jets can be tap water, distilled water or ozonated water. Using ozonated water in the high pressure jets to remove the bast from the hurd can serve as a pre-cleaning of the hurd, and can oxidize any bacterial or mold contamination on the surface. Ozonation can at least partially sterilize the hurd. Repeated treatments can be used if necessary to remove any residual traces of bast from the hurd.

Once the bast has been removed from the hurd, the stalks of hurd can be exposed to natural sunlight for a period of time from about 1 to about 200 hours, such as from about 12 to about 170 hours, or about 10 to about 100 hours, or about 5 to about 50 hours. Alternatively, or in addition, once the bast has been removed from the hurd, the stalks of hurd can be exposed to synthetic sunlight for a period of time from about 1 to about 200 hours, such as from about 12 to about 170 hours, or about 10 to about 100 hours, or about 5 to about 50 hours. The irradiance of the light, measured at the surface of the stalks, can be from at or about 10 W/m$^2$ to at or about 1,000 W/m$^2$, or from at or about 20 W/m$^2$ to at or about 500 W/m$^2$, or from at or about 30 W/m$^2$ to at or about 200 W/m$^2$, or from at or about 40 W/m$^2$ to at or about 100 W/m$^2$. The irradiance of the light, measured at the surface of the stalks, can be at least 25 W/m$^2$, or at least 50 W/m$^2$, or at least 75 W/m$^2$, or at least 100 W/m$^2$. The stalks can be maintained on a vibrating table or vibrating conveyor to expose different surfaces of the stalks to the synthetic sunlight due to the vibrations causing shifting and repositioning of the stalks on the table or conveyor.

The synthetic sunlight can be provided by including a plurality of lamps that simulate sunlight, e.g., containing a spectral content similar to that of sunlight. Lamp types that can be used to generate synthetic sunlight include high pressure metal arc lamps, high pressure ceramic metal arc lamps, metal halide arc lamps, xenon arc lamps, quartz tungsten halogen lamps, light-emitting diodes, and combinations thereof. For example, the synthetic sunlight can be generated by using a high pressure sodium enhanced spectrum lamp. Such lamps are commercially available (e.g., EYE Hortilux Super HPS lamps, EYE Hortilux, Mentor, OH; and TLEDs from Secret Jardin, Manage, Belgium). Exposure to the synthetic sunlight results in bleaching of the exterior hurd fibers without the need for any chlorination or exposure to other halogenated chemicals. The light exposure also reduces the amount of residual moisture in the hurd. The temperature in the treatment area can be maintained at a temperature of 30° C. or below. The temperature in the treatment area can be maintained at a temperature in the range of from about 20° C. to about 30° C., or from about 24° C. to about 27° C. Natural sunlight also can be used, alone or in combination with the synthetic sunlight. Ozone can be provided by using an ozone generator to provide ozone to the treatment area. For example, an ozone generator (e.g., Uvonair® CD-800, with an 8" duct system) can be used to provide ozone to areas from about 10,000 cubic ft. (300 $m^3$) to about 20,000 cubic ft. (600 $m^3$).

After the hurd has been exposed to the synthetic sunlight for the desired amount of time, the hurd is mechanically reduced in size. Any equipment known in the art can be used to reduce the size of the hurd. Examples include chippers and shredders (e.g., see U.S. Pat. No. 4,155,384 (Svensson, 1979); U.S. Pat. No. 4,162,769 (Lapointe, 1979); U.S. Pat. No. 5,005,620 (Morey, 1991); U.S. Pat. No. 5,205,496 (O'Donnell et al., 1993); and U.S. Pat. No. 7,011,258 (O'Halloran et al., 2006)). An exemplary shredder is a gas-powered 6.5 HP (212cc) chipper/shredder from Predator Outdoor Power Equipment.

The at least partially fibrillated cellulosic hurd fiber then is subjected to an abiotic retting process that removes pectin from the fibers. Normal retting is a process that relies on the action of bacteria to depolymerize and remove pectins that can be present in the hurd. The bacterial process can produce variable results due to the growth conditions required to promote bacterial degradation of the pectin. In the abiotic process used herein, dependency on bacteria is removed, because the at least partially fibrillated hurd fibers are subjected to an elevated pH and elevated temperature treatment that results in the depolymerization of any pectin present in the fibers. The hurd fibers are added to a vessel capable of maintaining elevated temperatures and compatible with alkaline conditions. In some applications, the process can be performed at elevated pressures, or can be performed at ambient pressures. The alkaline processing conditions also can help to separate the cellulosic hurd fibers from each other. After the alkaline process is performed for the desired amount of time, washing with excess water removes the alkalizing agent and the extracted binding components, such as pectins.

An alkalizing agent is dissolved in distilled or deionized water. Addition of the alkalizing agent to the water results in an alkaline mixture, typically having a pH of from about 9.8 to about 11.8. Exemplary alkalizing agents include sodium carbonate, sodium bicarbonate, potassium carbonate, potassium bicarbonate, sodium hydroxide, potassium hydroxide, or any combination thereof. In some applications, the alkalizing agent includes sodium carbonate. The alkalizing agent can be used in an amount from about 20% to about 60% by weight based on the total weight of the fiber. The alkalizing agent can be used in an amount at least about 20% by weight based on the total weight of the fiber, or an amount at least about 40% by weight based on the total weight of the fiber, or an amount at least about 50% by weight based on the total weight of the fiber.

The at least partially fibrillated hurd fibers are dispersed in the solution containing the alkalizing agent. The alkaline solution containing the at least partially fibrillated hurd fibers dispersed therein is heated to a temperature of up to 105° C. and this temperature can be maintained with occasional or constant mixing for a period of from 0.5 to 8 hours, such as from 1 to 5 hours, or 2 to 4 hours, or 0.5 to 3 hours.

After the fibers have been treated for the desired length of time in the alkaline mixture, the mixture is strained through appropriate sized screens to dewater the resulting pulp. The pulp on the screens can be washed with water to decrease the pH of the pulp. For example, the pulp on the screens can be washed with distilled or deionized water until the pH of the wash water is 9 or less, or 8.5 or less, or 8 or less, or 7.5 or less. A fruit acid solution optionally also can be used to treat the alkaline solution to reduce the pH.

Once a targeted pH is achieved, such as the wash water having a pH of 8 or less, the fiber optionally can be treated with an enzyme. For example, the fibers can be treated with pectinases, or ligninase (ligninolytic enzymes including laccase, lignin lyase and lignin peroxidase), or a combination thereof. A large number of enzymes are known to degrade pectins. Examples of such enzymes are pectin esterase, pectin lyase (also called pectin trans-eliminase), pectate lyase, and endo-polygalacturonase or exo-polygalacturonase. These enzymes are commercially available, such as from Sigma-Aldrich. A commercial pectolytic enzyme preparation solid under the tradename Rapidase Press® is available from DSM Food Specialities BV, The Netherlands. For example, the pH of the pulp can be reduced to about 3.5 to about 5.5, and the pectinase (Rapidase Press®) can be added in an amount from about 10 g to 100 g per ton of fiber. The temperature of the process can be ambient temperature, such as from about 20° C. to about 25° C. The fiber can be exposed to the enzyme treatment for a time period of from about 30 to 75 minutes.

For deliginfication, a laccase enzyme can be added to the pulp and the pulp can react with the laccase for a period from about 2 hours to 24 hours. The pH of the pulp can be maintained in the range of from about 3.5 to about 5.5, and the can be added in an amount from about 10 g to 100 g per ton of fiber. The pH can be monitored using a pH probe, and additional acid can be added to maintain the targeted pH range. The temperature of the process can be ambient temperature, such as from about 20° C. to about 25° C. Treatment with the laccase can result in high delignification resulting in a whiter, brighter fiber.

After the fibers have been washed, or following the optional enzymatic treatment(s), the fibers can be suspended in ozonated water and exposed to artificial sunlight for a time period of from 1 hr to 100 hrs, such as from 2 to 24 hours in a room in which relative humidity and temperature can be modulated. The temperature can be maintained at a temperature of at or below 30° C., such as in a range of from about 23° C. to about 29° C., or in a range of from about 24° C. to about 27° C., and a relative humidity of less than about 40%, such as in a range of from about 20% to about 40%, or in a range of from about 25% to about 35%. Some of the lignin compounds remaining in the pulp can be broken down via catalytic cleavage and further oxidation due to the ozone and the synthetic sunlight. The fibers can be maintained on trays lined with a reflective liner to increase fiber exposure to the synthetic sunlight. Cannabis hurd fibers in a slurry can be exposed to ozone, alone or in combination with exposure to synthetic sunlight. The slurry can be placed on trays that include a pump positioned to remove pulp slurry from one end of the tray and redeposit the slurry on the opposite end of the tray to promote circulation of the slurry across the surface of the tray, providing mixing and exposure of different surfaces of the fiber to the synthetic sunlight. The tray can include inlets for injecting ozone into the slurry periodically to maintain a high level of ozone in the slurry while the slurry is exposed to the light. The fibers can be maintained in a circulating vat, the surface of which is exposed to the synthetic sunlight. The vat includes blades or mixers that can circulate the slurry so that the fibers continuously are moved to the surface to be exposed to the light. The circulating vat can include inlets for injecting ozone into the slurry periodically to maintain a high level of ozone in the slurry while the slurry is exposed to the light. The level of ozone in the slurry can be at least 25 μg/mL, or 50 μg/mL, or at least 55 μg/mL, or at least 60 μg/mL, or at least 65 μg/mL, or at least 70 μg/mL, or at least 75 μg/mL. The level of ozone in the slurry can be from at or about 50 μg/mL to at or about 100 μg/mL. The level of ozone in the slurry can be from at or about 65 μg/mL to at or about 80 μg/mL.

When used, synthetic sunlight can be applied at an irradiance, measured at the surface of the slurry, can be from at or about 10 $W/m^2$ to at or about 1,000 $W/m^2$, or from at or about 20 $W/m^2$ to at or about 500 $W/m^2$, or from at or about 30 $W/m^2$ to at or about 200 $W/m^2$, or from at or about 40 $W/m^2$ to at or about 100 $W/m^2$. The irradiance of the light, measured at the surface of the slurry, can be at least 25 $W/m^2$, or at least 50 $W/m^2$, or at least 75 $W/m^2$, or at least 100 $W/m^2$.

After the fibers have been ozonated and optionally treated with synthetic sunlight for the desired length of time, the resulting treated fibers can be pressed to remove excess water and the resulting purified pulp can be stored for future use, or used for product manufacture, or shipped to papermaking or paper package-making facilities. When the purified pulp is to be stored for an extended period of time, the final wash water can be ozonated to provide residual antibacterial and antimicrobial properties to the dewatered pulp. Natural preservatives, such as ascorbic acid and citric acid, which are naturally occurring fruit acids, also can be incorporated into the dewatered pulp for long-term storage.

The resulting purified hurd fibers typically have an arithmetic mean fiber length of from about 0.15 mm to about 0.75 mm. The purified hurd fibers can have an arithmetic mean fiber length of from about 0.35 mm to about 0.65 mm. The purified hurd fibers can have a mean length weighted in length of from about 0.6 mm to about 0.7 mm. The purified hurd fibers can have an average width of from about 23 μm to about 30 μm. The purified hurd fibers can have an average percentage of kinked fibers from about 13 to about 16%. The purified hurd fibers can have an average percentage of broken ends of from about 8% to about 12%.

Smoking Paper Formation

Throughout the centuries plant pulp has been used to make paper, which has been used for several different purposes, including communication, packaging and drug delivery, such as smoking paper. Ink receptive paper and smoking paper have different requirements, but include as a common ingredient cellulosic fiber from a plant source. Smoking paper has been formulated for use to smoke tobacco and herbs, including cannabis, for decades.

Figure 2:
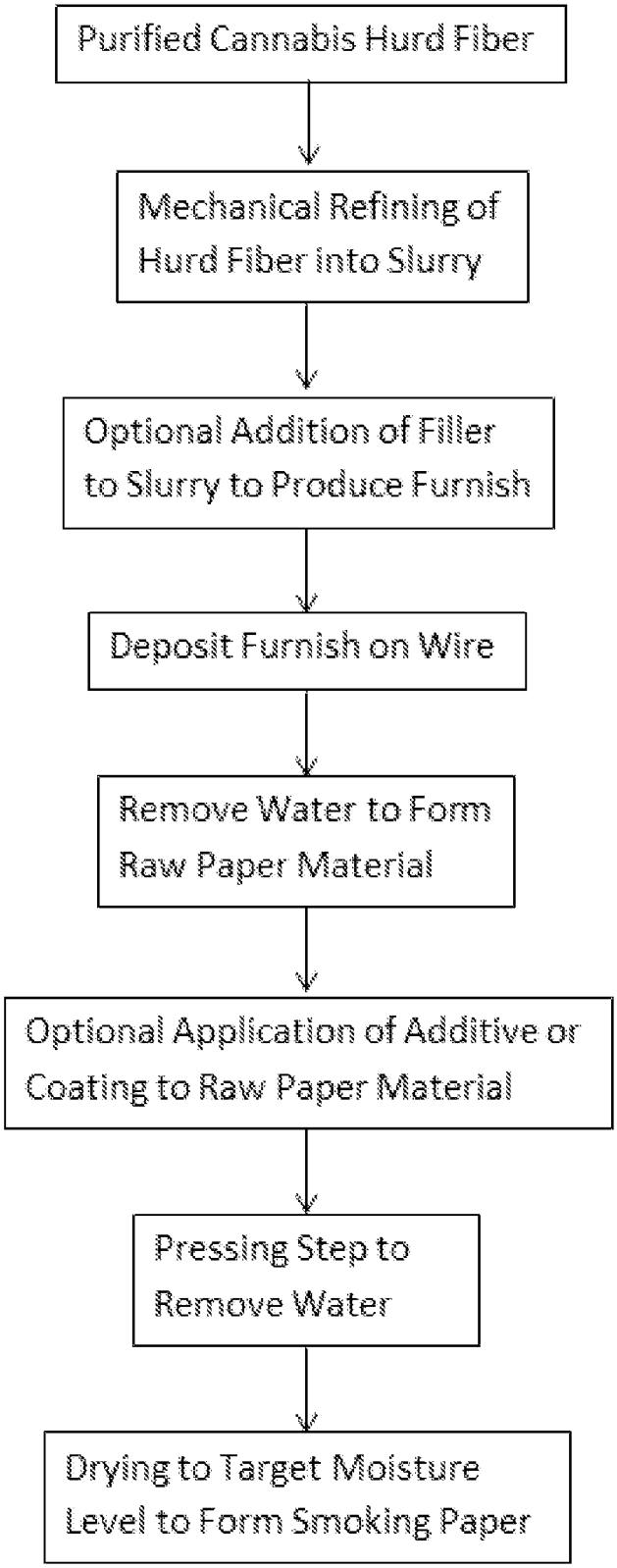
FIG. 2 illustrates an exemplary process for production of a smoking paper containing cellulosic fiber from the hurd of the cannabis stalk.

The dewatered purified cannabis hurd pulp prepared as described herein can be used for the manufacture of smoking paper. An exemplary embodiment of the smoking paper manufacturing process is shown in the flow chart of FIG. 2. The purified cannabis hurd fiber prepared as described above is subjected to mechanical refining to produce a refined fiber. The refining process increases the total surface of the fibers available for bonding. After refining, one or more fillers optionally can be added to the slurry to produce a furnish. The slurry then can be deposited on the wire of the papermaking device or apparatus, followed by removal of water from the furnish to produce a raw paper material. An additive or coating or both optionally can be applied to a surface of the raw paper material. The raw paper material or treated raw paper material then is subjected to a pressing step that applies pressure to the raw paper material to remove water, followed by a drying step to apply thermal energy to remove water to a target moisture level in the smoking paper.

The first step of the papermaking process provided herein using the purified hurd fiber is refining of the purified cannabis hurd fiber that has been prepared as described above. The purified hurd fiber is added to a hydro-pulper with warm to hot water (10-100° C., such as 50-90° C.) to result in a percentage of pulp in the water of about 1 wt % to about 25 wt %, such as from about 1 wt % to about 10 wt %. The mixture is mixed for a period of time from about 10 minutes to 60 minutes.

The dispersed fiber then is subjected to mechanical refining. The slurry optionally can be diluted to a concentration of about 0.1 wt % to about 5 wt % fiber in the slurry prior to refining. Refining can be achieved using any fibrillating equipment known in the art. Exemplary equipment for refining the fiber includes a Hollander beater, a conflo refiner, a conical refiner, a disc refiner, a double disc refiner, a British disintegrator, an angle disintegrator, a blender, a homogenizer, a microfluidizer, or any combination thereof. These can be used singly or in any combination. When a blender is included, the blender can be fitted with one or more blades, and the blades can be X style, wing style, or combinations thereof. Exemplary blenders and blades are described, e.g., in U.S. Pat. No. 6,632,013 (Wulf et al., 2003); U.S. Pat. No. 6,974,099 (Kolar et al., 2005); U.S. Pat. No. 6,981,795 (Nikkah, 2006); U.S. Pat. No. 8,197,121 (Sands, 2012); and U.S. Pat. No. 8,444,076 (Rukavina, 2013)).

In some applications, the mechanical refiner can include a disk or conical refiner with plates designed for low intensity or medium intensity refining. In some applications, the mechanical refiner can include a double disc refiner. The refining can include a thermo-mechanical refining process that includes refining under high temperature and elevated pressure, such as a pressure of from about 2 bars to about 16 bars, and a temperature greater than about 150° C. up to about 185° C.

The energy intensity imparted to the fiber from the refiner should be such that the fiber bundles are mostly separated into individual fibers. Exemplary energy intensities are in the range of from about 20 to about 120 kWh/ton of fiber.

The beating degree of the pulp is not particularly limited. For example, the cannabis hurd pulp can be exposed to a high beating degree to produce a pulp having a Canadian standard freeness of about 500 mL or less, or 475 mL or less (as measured using Canadian Standard Freeness (CSF), TAPPI Standard T 227 om-09, Tentative Standard—1943, Test Method Freeness of pulp (Canadian Standard method), Revised 2009). The Canadian standard freeness is a value of freeness per gram of pulp by absolute dry weight, using a sieve used in a standard Canadian standard freeness tester. It has been determined that, as the amount of beating the pulp is exposed to increases, the amount of side stream smoke from a smoking article wrapped in the cannabis hurd fiber paper decreases.

The cannabis hurd fiber slurry can be prepared to have a consistency of about 1.6% or less, or about 1.55% or less. Consistency can be measured using TAPPI T 240 om-12—Consistency standard test method. The cannabis hurd fiber can have a coarseness (average weight of fiber per unit length) of from about 0.195 to about 0.285 mg/m).

The basis weight of the smoking paper is not particularly limited as long as it falls within the range suitable for a smoking paper. For example, the pulp can be formulated to produce a smoking paper after being manufactured having a basis weight of from about 15 to about 90 g/m$^2$. In some applications, the basis weight can be in the range of from about 18 g/m$^2$ to about 40 g/m$^2$, or from about 25 g/m$^2$ to about 50 g/m$^2$, or from about 45 to about 75 g/m$^2$. The smoking paper can have a basis weight of from about 6 pounds/ream to about 10 pounds/ream, or from about 6.5 pounds/ream to about 9 pounds/ream (based on a basic size of 17×22 inches per sheet). Higher basis weight and even dryness of the paper can prevent canoeing of the paper during smoking.

The smoking paper can be prepared using any known wet-laid papermaking process and equipment. Sheets also can be made by hand, or in a small-scale laboratory papermaking apparatus. An exemplary large-scale papermaking machine is a Fourdrinier machine. In general, the purified cannabis hurd fiber is refined in water to make a slurry, the slurry is deposited on the wire of the papermaking machine or apparatus, and the water from the slurry is removed to form a raw paper material, and the raw paper material is optionally pressed and then dried to form the paper. Papermaking equipment is available commercially, such as from Perry Videx (Hainesport, N.J.).

A deckle can be used to limit the size of the sheet. In large scale production, the deckle includes a continuous belt on either side of the forming wire. For smaller productions, or production by hand, the deckle can include a frame of a mold to shape the pulp as the water is removed from the pulp slurry. The wire can include a watermark. The watermark can be designed and positioned to modulate the burn characteristics of the paper. For example, the watermark can be positioned on the paper to modulate the burn rate of the paper. For example, the watermark can include a repeating pattern that, when rolled to form a smoking article, results in the formation of a series of rings of the repeating pattern about the circumference of the smoking article along at least a portion the length of the smoking article. The watermark can produce areas of increased and decreased fiber concentrations in the paper, and the repeating pattern about the circumference of the smoking article can promote a circular burn pattern during use of the smoking article. The watermark can minimize or prevent uneven burning or canoeing of the paper of the smoking article during use.

The smoking paper of the present invention can include a filler or an additive or a combination thereof generally used in traditional cigarette papers, but such fillers or additives are not required to yield a smoking paper with good smoking, burn and ash characteristics. Examples of fillers or additives that optionally can be included in the smoking paper include starch, gum arabic, calcium carbonate, magnesium carbonate, clay, calcined clay, kaolin, titanium oxide, a fruit acid, or any combination thereof.

Calcium carbonate, clay, calcined clay, kaolin, or a combination thereof can be added as filler to improve optical properties and burning characteristics of the paper. When included, the calcium carbonate, clay, calcined clay, kaolin, or a combination thereof can be present in an amount of from about 2.5 wt % to about 60 wt % based on the overall weight of the smoking paper. For example, the smoking paper can include from about 25 wt % to about 50 wt % calcium carbonate, and from about 5 wt % to about 25 wt % calcined clay. Addition of greater than 60 wt % of these fillers has a negative impact on the tensile strength of the paper. When used, the form of calcium carbonate included is not particularly limited. The particles can be scalenohedral or rhombohedral or acicular, and combinations of these particle forms can be used. Amorphous calcium carbonate also can be used. The calcium carbonate particles can aggregate to form combinations of larger particles. The size of the individual calcium carbonate particles is not particularly limited. The particles can have a size in the range of from about 0.05 μm to about 0.15 The calcium carbonate can modify the permeability of the final smoking paper, and thus the rate at which the smoking paper burns. In addition, as the size of the calcium carbonate particle included in the paper increases, the pores in the paper become larger.

Clay and calcined clay are naturally occurring particulate materials including crystalline minerals. Calcined clay is clay that has been subjected to heat treatment. Kaolin is a fine, white clay, usually resulting from the natural decomposition of other clays. Typically, no more than 30 wt % clay or calcined clay based on the overall weight of the smoking paper is included, because no further improvement in optical properties or burn characteristics is achieved when more than 30 wt % clay or calcined clay is included. The clay particles can have a size in the range of from about 0.01 μm to about The calcium carbonate, clay, calcined clay or kaolin, or any combination thereof, when used, is included in the furnish containing the purified cannabis hurd fibers. Fillers, such as calcium carbonate, clay, starch, gum arabic or combinations thereof, can be used to maintain fibrillation of a fiber, or inhibit hydrogen bonding of the fibrils, during and after drying. Other fillers that can be included in the furnish include, but are not limited to, starch, dextrin, and maltodextrin.

A burn rate modifier optionally can be included in the smoking paper. A sodium or potassium salt of a naturally occurring fruit acid can be included to modify the burn rate of the paper. Any carboxylic acid from a fruit source can be included. Exemplary fruit acids include citric acid, maleic acid, tartaric acid, gluconic acid, fumaric acid and succinic acid and combinations thereof. In some applications, sodium citrate or sodium succinate or a combination thereof is included as a burn rate modifier. The burn rate modifier can be included in an amount of from about 0.5 wt % to less than 10 wt % based on the overall weight of the smoking paper. Including an amount of burn rate modifier that is greater than 10 wt % based on the overall weight of the smoking paper can have a negative impact on burn characteristics and impart an undesired taste or flavor. Typically, the amount of burn rate modifier included in the smoking paper is from about 0.5 wt % to about 5 wt %. In addition to modulating the burn rate of the smoking paper, the fruit acid also can act as a fixing agent that can interact with any calcium carbonate filler to help form a relatively air- and smoke-impervious ash. The imperviousness of the ash also can be promoted by selecting a calcium carbonate having a high surface area.

A film forming polymer also can be included on the smoking paper. Exemplary film forming polymers include starch, gum arabic and modified celluloses, such as carboxymethyl cellulose. The film forming polymer can be present in an amount of from about 0.1 wt % to about 5 wt % based on the overall weight of the smoking paper. The film forming polymer can improve the cohesiveness of the resulting ash when the paper is burned, can result in a smoother smoke by directing the air stream through the smoking material, and can help minimize sidestream smoke. The polymer solution also can act as a carrier for the burn rate modifier.

The additive or film forming polymer is added after formation of the raw paper material. For example, a raw paper material is formed by directing a slurry containing the purified cannabis hurd fiber, optionally a filler, and a large amount of water to the wire screen of a papermaking machine, removing water from the slurry on the wire of the paper making machine to form a raw paper material, and then coating a solution containing the additive or film forming polymer over the raw paper material. The raw paper material then is pressed to remove residual water followed by drying to yield the smoking paper.

The addition of the additive or film forming polymer is alternatively performed in a processing step after the paper making step by coating the additive or polymer dissolved in water or an organic solvent onto the pressed paper followed by drying the resulting treated paper material to yield the smoking paper.

The raw paper material, before or after addition of any additive or film forming polymer, can be pressed to remove water. The pressing can be achieved by passing the raw paper through the nip formed between two rollers. The pressure exerted by rollers on the raw paper material is not particularly limited. The pressing also can be achieved by using a hydraulic or pneumatic or mechanical press. A pressure sufficient to force water from the raw paper material generally is selected so that the water within the raw paper material can flow out at an optimum rate to achieve maximum dewatering without fiber disruption. Pressures in a range of from about 100 psi to about 1000 psi can be used. The more water removed through the pressing process reduces the amount of thermal energy required to dry the final smoking paper product.

The paper is dried using any technique or equipment known in the art. For example, the paper can be dried by exposure to infrared irradiation, or exposure to hot air streams, or generating thermal energy in the wet raw paper material structure using microwave radiation, or by contact with hot dryer cans, or any combination thereof. The raw paper material is exposed to thermal energy to drive off water. Drying can be accomplished using oven drying, air drying, jet drying, contact drying or any combination of these. The temperature at which drying is performed can be from 40° C. to 160° C. The amount of time required to dry the smoking paper will depend upon the type of drying used. Drying time can vary from a few seconds for jet drying to several hours for oven drying. The time required to dry the smoking paper also will depend upon the final moisture content of the smoking paper. The water or moisture content in the dried smoking paper can be from 1% to 10% of the weight of the paper. The water or moisture content in the dried smoking paper can be from about 6% to about 9% of the weight of the paper. The water or moisture content in the dried smoking paper can be from about 6.4% to about 8.4% of the weight of the paper.

The basis weight of the smoking paper provided herein is not particularly limited but generally is selected to be within the range of basis weight usually used for smoking paper. In some applications, the smoking paper provided herein containing the purified cannabis hurd fiber has a basis weight of from about 15 to about 85 $g/m^2$, or from about 20 to about 70 $g/m^2$. Higher basis weight, such as from 50 to 70 $g/m^2$, can be selected to decrease side stream smoke.

The permeability of the paper can be in the range of from about 2 to about 45 cubic centimeters per minute ($cm^3 \cdot min^{-1}$) as tested by the CORESTA Recommended Method No. 40 (1994, the CORESTA method), and can be increased to about 50-100 or 60-80 $cm^3 \cdot min^{-1}$, for example, by perforation (see, e.g., U.S. Pat. No. 4,320,773 (Pinck et al., 1982) and U.S. Pat. No. 5,684,617 (Langhans, 1997); and U.S. Pat. App. Pub. No. 20130104915 (Eitzinger, 2013)).

For some applications, the smoking paper can have a basis weight of from about 15 to about 25 $g/m^2$, and a permeability of from about 20 to about 45 $cm^3 \cdot min^{-1}$ by the CORESTA method. In some applications, the paper contains no filler or burn rate modifier. In some applications, the smoking paper includes a calcium carbonate content from about 1.5 wt % to about 25wt %, and a burn rate modifier (such as sodium or potassium citrate or succinate or combinations thereof) in an amount of from about 0.5 wt % to about 2.5 wt %.

The smoking paper can be further refined after drying. For example, the smoking paper can be calendared to provide a smooth finish. The calendar typically includes a plurality of rolls that form nips between the rolls. Typically, the nip is formed between one hard roll and one soft roll. The plurality of nips allow the paper to be calendared to a high smoothness. The pressure in the calendaring nip can be in the range of from about 0.5 to about 15 MPa (which is the same as about 50 to about 1,500 Newton per square centimeter ($N/cm^2$)). In some applications, the pressure used in the calendar is higher than 4 MPa. The calender temperature at the nip is typically in the range of about 120 to about 250° C., but higher or lower temperatures can be used. Methods of calendaring paper are known and described in the art. For example, see U.S. Pat. No. 5,522,312 (Johnson, 1996); U.S. Pat. No. 5,836,242 (Aberg, 1998); U.S. Pat. No. 6,305,280 (Beckers, 2001); U.S. Pat. No. 6,712,938 (Leppakoski et al, 2004); U.S. Pat. No. 6,869,505 (Lares et al., 2005); and U.S. Pat. No. 8,440,054 (Svenka et al., 2013). The final paper can be cut to the appropriate size or dimension and packaged.

Paper Packaging Material

The present invention also is directed to the use of cannabis hurd fibers in the formation of paper packaging products, such as cardboard or stock. Such paper packaging products may be formed using the systems and methods described in U.S. Pat. No. 4,046,252 (Korby et al., 1977); U.S. Pat. No. 4,500,381 (Nordstrom, 1985); U.S. Pat. No. 4,617,223 (Hiscock et al., 1986); U.S. Pat. No. 4,913,773 (Knudsen et al., 1990); U.S. Pat. No. 5,044,550 (Lamm, 1991); U.S. Pat. No. 5,059,459 (Huffman, 1991); U.S. Pat. No. 6,164,444 (Bray et al., 2000); U.S. Pat. No. 6,387,210 (Hsu et al., 2002); U.S. Pat. No. 6,669,814 (Hansen et al., 2003); U.S. Pat. No. 6,919,111 (Swoboda et al., 2005); and U.S. Pat. No. 7,381,300 (Skaggs et al., 2008).

The dewatered cannabis hurd pulp can be used for the manufacture of paper packaging material. Paper packaging material can include heavyweight paper, linerboard and paperboard. Packaging paper and linerboard traditionally have been made from kraft pulp or waste paper containing kraft pulp. Kraft pulp is a pulp which is produced by digesting wood materials by means of a kraft digesting chemical containing sodium sulfide, so that sulfur compounds such as sulfides and sulfated lignin by-products can remain in the kraft pulp. Provided herein are paper packaging materials that contain only cannabis hurd fiber, or combinations of cannabis hurd fiber with other fiber types. When present, any other fiber pulp used with the cannabis hurd fiber for the packaging material can be selected so that it contains little to no sulfur.

The kind of non-cannabis pulp used with the cannabis hurd fiber is not restricted, other than there is no detectable sulfur in the pulp. Pulp from hardwood trees, such as oak, beech, poplar, birch or eucalyptus or any combination thereof can be used, alone or in combination with pulp from softwood trees, such as pine and spruce. Pulp obtained through digesting by known methods such as the kraft process, sulfite process, soda process, or sodium carbonate process, as well as a pulp prepared from waste paper, can be used with the cannabis hurd fiber. Among these pulps, the pulps prepared by using a digesting solution containing no sulfur, such as the soda process and the sodium carbonate process, are preferred. Cannabis bast fiber also can be used. In some applications, the paper packaging product contains only cannabis hurd fiber, or cannabis hurd fiber in combination with cannabis bast fiber.

The cannabis bast fibers can be prepared using the methods described herein for preparation of the cannabis hurd fiber, including exposure to synthetic sunlight and ozone, pulped, and combined with the hurd fiber to be incorporated into packaging material.

There is no restriction on the type of packaging material that can be made containing cannabis hurd fiber, nor any restriction on the use or application of the paper packaging product. The paper packaging material of the instant invention includes all types of packaging papers such as liners for corrugated box, corrugate medium, case materials, wrappings, folding boxboard, ordinary white folding carton, cardboard for cartons, ordinary packaging paper sheet and other papers and paperboard which are usable in packaging. The paper packaging materials containing cannabis hurd fibers provided herein can be formed into boxes, cartons, cases and other containers by folding, bonding, adhesive and other suitable techniques.

The paper packaging material can include a moisture barrier, either for keeping moisture in the product contained in the packaging, or preventing moisture from entering the package. For example, the packaging material can include a polyethylene film. Polyethylene films, which can be laminated or coated on the paper packaging material, are widely used in packaging applications to protect products from moisture and provide water or grease resistance. In some configurations, the packaging material can be a multi-ply product having a ply of polyethylene adjacent to at least one surface of a paper substrate, or having a center ply of polyethylene in between two other plys of a paper substrate. The paper packaging material can have a print-receptive layer to allow application of ink for labelling or decoration. The paper packaging material can have a calendered print-receptive layer outer surface that has a Parker Print-Surf (PPS) roughness value of about 1.6 or less. The paper packaging can include a coating of energy-curable monomers that when cured form a moisture barrier layer comprising one or more energy-cured polymers positioned over the outer surface to provide a printed packaging material having a water vapor transportation rate of about 500 $g/m^2$/day or less.

A benefit of using an energy-curable coating to form a moisture barrier layer is that the amount of solids in the coating can be increased, which can decrease the amount of penetration of the coating into and through the paper or the packaging material surface, thereby keeping more coating solids on the outer surface of the paper or packaging material. Upon exposure to energy to polymerize or cross-link the monomers or oligomers, the energy-curable coating is converted into one or more energy-cured polymers forming the moisture barrier layer. The coat weight of the moisture barrier layer can be in the range from about 1 to about 10 gram/$m^2$ (gsm), such as from about 2 to about 8 gsm, or from about 3 to about 7 gsm. The moisture barrier layer provides moisture barrier protection for products contained within the packaging material. After the moisture barrier layer is formed, the packaging material can provide a water vapor transportation rate (WVTR) of about 500 $g/m^2$/day or less, or about 400 $g/m^2$/day or less, or about 300 $g/m^2$/day or less, or about 200 $g/m^2$/day or less.

An exemplary packaging product is a molded pulp carton, such as an egg carton. Egg carton structures to retain a dozen eggs in two rows of six each, and formed of molded material are well known see, for example, U.S. Pat. No. 3,337,110 (Commisso et al., 1967) and U.S. Pat. No. 3,356,284 (Lake, 1967). A typical egg carton can include a base having a plurality of egg cells, the base being attached to a lid and locking flap by at least one hinge member. The lid can have one or a plurality of closing apertures adapted to receive one or a plurality of buttons located on the locking flap. The egg carton structures are made of the purified cannabis hurd fiber provided herein, alone or in combination with other natural fibers or other material. For example, the egg carton structures can be molded out of the purified cannabis hurd fiber alone or in combination with paper pulp, cotton fibers, recycled plastic fibers, cannabis bast fibers, hemp fibers or any combination thereof.

The egg cartons are resistant to deformation, thereby cradling the eggs and preventing crushing, while at the same time being resilient and able to absorb minor shocks to prevent damage to the eggs within the carton structure. Cartons molded of the purified cannabis hurd fiber, alone or in combination with other fibrous pulp material, are particularly suitable for packaging fragile articles, because the molded pulp can exhibit resilient softness, and an irregular fibrous feel and appearance can imparts desirable cushioning characteristics to the carton. Many different styles of such molded pulp cartons for fragile articles such as eggs have been proposed, many of which have narrow ribs arranged in generally vertically radial array within one or more of the egg pockets, for various purposes. Representative designs of egg cartons are disclosed in U.S. Pat. No. 3,207,409 (Reifers, 1965); Snow U.S. Pat. No. 3,398,875 (Snow, 1968); U.S. Pat. No. 4,081,123 (Reifers, 1978); U.S. Pat. No. 4,088,259 (Sutton, 1978); U.S. Pat. No. 6,012,583 (Ramirez, 2000); and U.S. Pat. No. 7,255,231 (Andrews et al., 2007).

A molded pulp egg carton of the type having a pocketed bottom with a closeable cover integrally hinged to it where the cover has compact thickness, rigid firmness and densified hardness qualities can be obtained by being simultaneously dried and finish-formed between mating heated pressing molds, and the bottom having a non-compacted consistency, resilient softness and an irregular fibrous feel and appearance can be obtained by being dried in a free space, defined by slots in a drying and pressing mold, without finish-forming pressure.

Molded pulp cartons include any contoured cartons molded to essentially finished shape by the suction deposition of fibrous pulp materials from an aqueous slurry thereof against screen-covered, open-face forming molds, followed by subsequent drying, and any of these can include the purified cannabis hurd fiber provided herein. A tremendous number of different styles of molded pulp cartons are used for packaging a wide and diverse range of commodities, including the retail merchandizing of fragile articles, such as eggs, light bulbs, and Christmas tree ornaments.

Machinery for producing an egg carton of the type described above is well known in the art and typically include a supply for proving an aqueous slurry of fibrous pulp material, a porous or foraminous vacuum forming mold, a heated vacuum drying mold, a heated solid metal finishing mold, and a vacuum transfer mold. An exemplary apparatus is described in informative detail in U.S. Pat. No. 2,183,869 (Randall, 1939).

Absorbent Paper Products

The present invention also is directed to the use of cannabis hurd fibers in the formation of absorbent paper products, such as paper towels, tissues, napkins, and toilet paper. Processes for depositing non-woven fibers, such as cellulosic fibers, in an aqueous suspension onto a foraminous support (usually referred to as a wire) are well known. Once deposited, the aqueous suspension is allowed to drain, so that there is left a deposited layer of fibers on the support in the form of a wet web. Methods of manufacturing absorbent paper products are described in U.S. Pat. No. 3,954,554 (Curry et al., 1976); U.S. Pat. No. 4,344,818 (Nuttall et al., 1982); U.S. Pat. No. 4,543,142 (Kuepper et al., 1985); U.S. Pat. No. 4,759,967 (Bauernfeind, 1988); U.S. Pat. No. 5,087,324 (Awofeso et al., 1992); U.S. Pat. No. 5,227,023 (Pounder et al., 1993); U.S. Pat. No. 5,348,620 (Hermans et al., 1994); U.S. Pat. No. 5,501,768 (Hermans et al, 1996); U.S. Pat. No. 5,620,565 (Lazorisak et al, 1997); U.S. Pat. No. 5,972,456 (Esquivel, 1999); U.S. Pat. No. 6,241,853 (Smith et al, 2001); U.S. Pat. No. 6,727,004 (Goulet et al., 2004); and U.S. Pat. No. 8,034,215 (Knobloch et al., 2011).

Absorbent paper products traditionally are made as one to two ply products, or multi-ply products, and can contain either ordinary or high density paper. Creping the paper can be performed to provide absorbent, soft and bulky, creped tissue or towel material. The traditional fibers, usually bleached hardwood or softwood fibers or combinations thereof, can be replaced or supplemented with the cannabis hurd fiber prepared as described herein. For some products, cannabis hurd fiber is the only cellulosic fiber present in the product. For some products cannabis hurd fiber can be used in combination with softwood or hardwood fiber or combinations thereof, or other natural plant fibers.

U.S. Pat. App. Pub. No. US2016/0130762 (Ramaratnam et al., 2016) describes methods of preparing toilet paper that contains cannabis bast fiber. The absorbent toilet paper products provided herein do not include cannabis bast fiber or hemp bast fiber.

The absorbent paper products containing the purified cannabis hurd fiber possess strength, softness and absorbency. The inclusion of the purified cannabis hurd fiber results in a new type of paper towel, tissue, napkin and toilet paper product that exhibits high strength, while still maintaining good absorbency and softness. When papers and/or tissue products containing the purified cannabis hurd fiber described herein are produced, even when using a single headbox pressure for the deposited layers therein, the produced layers can possess different tensile strengths, depending on the speed of the manufacturing process.

Ink Receptive Paper Products

Another object of the present invention is to provide a use for cannabis hurd fibers, alone or in combination with one or more additional fibers, such as cannabis bast fiber, softwood fiber, hardwood fiber, cotton fiber, linen fibers or combinations thereof, such as for the manufacture of an ink receptive paper, such as writing paper, copying paper, labels and label stock, release paper, text paper, cover paper, magazine and newsprint paper, and tag paper.

Methods of making ink receptive paper are known and have been used for decades. The methods typically include preparation of a slurry of the cellulosic fibers, adding any fillers, such as calcium carbonate, to the slurry to prepare a furnish, depositing the furnish onto a foraminous support (wire), draining the water from the furnish to form a wet paper web, followed by pressing, and drying, and optionally calendering and sizing. The cannabis hurd fiber produced as described herein has low curl. Using fibers with lower curl tends to lead to production of paper having a higher tensile strength and higher elastic modulus.

EXAMPLES

Example 1

Stocks of cannabis plants grown for medicinal purposes were collected and were soaked in distilled water for 7 days. The outer bast fiber was removed from the inner hurd using a high-pressure water jet (3600 psi pressure washer, using the RIGID® power washer from Ridge Tool Company, Elyria, OH). The hurd was soaked in distilled water for 24 hours. The hurd then was placed in a controlled environment enclosure. The enclosure included fans to keep the air within the chamber circulating, and a dehumidifier adjusted the relative humidity within the chamber. The chamber was maintained to be mold- and microbe-free, by maintaining a biocidal level of ozone within the chamber. The ozone was produced by an ozone generator (O3Elite Single Stage Ozone Generator, Promolife, Inc., Fayetteville, AR, in combination with a Philips Respironics 1020000 EverFlo Home Oxygen Concentrator, Philips Respironics, Murrysville, PA).

The hurd stalks were reduced in size by chopping using a high powered tree/branch shredder (the 6.5 HP (212cc) chipper/shredder from Predator Outdoor Power Equipment). This resulted in the hurd being broken into small pieces, which were run through the shredder again, producing a cotton-like material. The controlled environment enclosure also was equipped with a plurality of 1,000 Watt high-pressure sodium lamps to provide synthetic sunlight. The irradiance of the light, measured at the surface of the broken down hurd, was 53.7 $W/m^2$. The broken-down hurd was exposed to the light from the high pressure sodium lamps for a total of 336 hours (2 weeks with 24 hours/day illumination).

Four gallons of deionized water was placed in a steam-heated stainless steel vat, and 254.4 g soda ash was added with mixing. After dissolution of the soda ash, 448 g of the cotton-like hurd fiber was added to the soda ash solution and heated with mixing to a temperature of 105° C. and maintained at this temperature for 5 hours.

The treated fibers had a pH of 9.8, and were washed with deionized water to remove any residual soda ash, until a pH of 8 was achieved. The fibers then were soaked in deionized water for 24 hours. The fibers were then placed into a NutriBullet blender 24 oz. cup (NutriBullet, LLC, Pacoima, CA) without addition of any liquid and subjected to mechanical shear, producing a fibrous material. This material then was suspended in deionized water to form a slurry, and the slurry was subjected to high shear in NutriBullet blender 24 oz. cup for 5 minutes, resulting in a pale yellow slurry.

The fiber slurry then was transferred to a stainless steel container and infused with ozone for 48 hours by bubbling ozone through a glass or stone bubbler attachment positioned at the bottom of the container so that the ozone bubbles upward through the slurry. The slurry was subjected to mixing while in the container to insure distribution of the ozone throughout the slurry. The slurry then was exposed to synthetic sunlight for 24 hours.

The resulting purified hurd fiber was pressed to remove water, and was ready for preparation of hand sheets. This final pulp was refrigerated if handsheet preparation was to occur more than 24 hours after preparation of the cannabis hurd fiber.

COMPARATIVE EXAMPLE

A comparative fiber was prepared from the hurd of hemp (cannabis grown for bast fiber production). The process used was the same as described in Example 1. The results are shown in Table 1.

TABLE 1

Comparison of the Fibers

| | Medicinal Cannabis Hurd Fiber | Hemp Hurd Fiber |
|---|---|---|
| Arithmetic Mean Length (mm) | 0.470 | 0.635 |
| Mean Length - Weighted in Length (mm) | 0.638 | 1.084 |
| Width (μm) | 25.6 | 21.6 |
| Number (million/g) | 9.605 | 3.956 |
| Coarseness (mg/m) | 0.205 | 0.341 |
| Curl (%) | 5.1 | 9.9 |
| Broken ends (%) | 9.27 | 23.76 |
| Kink angle (°) | 133 | 129 |
| Kinked fibers (%) | 14.7 | 29.8 |

As can be seen from the data, the hurd fiber from cannabis plants grown for medicinal purposes has structural characteristics that are significantly different from the hurd fiber from cannabis plants grown for fiber (hemp plants). There are more than twice as many fibers of medicinal cannabis hurd fibers per gram than hemp hurd fibers. The mean length of the medicinal cannabis hurd fibers is shorter than the hemp hurd fiber, but the medicinal cannabis hurd fibers have a greater width. Coarseness, which is a measure of weight per unit length of the fibers in a pulp, shows that the medicinal cannabis hurd fibers have a coarseness less than 0.66% of the coarseness of hemp hurd fibers.

The curl of the hemp hurd fibers is almost twice the curl of the medicinal cannabis hurd fibers, and the number of kinked fibers in the hemp hurd fiber is more than twice that in the medicinal cannabis hurd fibers. Higher fiber curl means higher fracture energy, lower breaking tension and higher breaking strain of a paper web. Using fibers with higher curl tends to lead to production of paper having low tensile strength and low elastic modulus. Using fiber with a high number of kinked fibers also tends to result in a paper having a lowered tensile strength and elastic modulus.

The data demonstrate that, even when processed under identical conditions, the cellulosic fiber obtained from the hurd of cannabis plants grown for medicinal purposes is physically different from the hurd of cannabis plants grown for fiber production (hemp). Accordingly, the cellulosic fiber obtained from the hurd of cannabis plants grown for medicinal purposes can be used to produce paper products, including ink receptive paper, smoking paper, absorbent paper products such as paper towels and tissues, and paper packaging materials, having properties that are different than that which could be obtained by using hemp hurd fibers. Accordingly, the methods provided herein provide a new use for the hurd of cannabis plants, which traditionally has been regarded as a waste product.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An ozonated medicinal cannabis non-hemp hurd fiber pulp from alkaline-treated and ozone-treated hurd from cannabis grown at a density lower than used for growing hemp, the lower density promoting branching, flowering and bud formation, and a lower ratio of bast to hurd than cannabis grown for hemp, wherein the hurd fiber pulp is substantially free of bast fiber and has an average percentage of kinked fibers from about 13% to about 16%.

2. The ozonated medicinal cannabis non-hemp hurd fiber pulp of claim 1, wherein the hurd fiber pulp contains no pectin.

3. The ozonated medicinal cannabis non-hemp hurd fiber pulp of claim 1, wherein the hurd fiber pulp has an arithmetic mean fiber length of from about 0.35 mm to about 0.47 mm.

4. The ozonated medicinal cannabis non-hemp hurd fiber pulp of claim 1, wherein the hurd fiber pulp has a curl of about 5%.

5. A molded pulp carton comprising 100 wt. % ozonated cannabis non-hemp hurd fiber from the ozonated medicinal cannabis non-hemp hurd fiber pulp of claim 1 as the cellulosic fiber.

6. The molded pulp carton of claim 5 that is an egg carton.

7. A cellulosic smoking paper, comprising ozonated cannabis non-hemp hurd fiber from the ozonated medicinal cannabis non-hemp hurd fiber pulp of claim 1 as the only cellulosic fiber in the cellulosic smoking paper.

8. A paper packaging material, comprising:

a paper substrate comprising 100% by weight of ozonated medicinal cannabis non-hemp hurd fiber from-the ozonated medicinal cannabis non-hemp hurd fiber pulp of claim 1 as the only cellulosic fiber in the paper substrate, the paper substrate-having an inner surface and an outer surface; and a moisture barrier layer comprising one or more energy-cured polymers positioned over the outer surface, wherein the packaging material has a water vapor transportation rate of about 500 $g/m^2$/day or less.

9. A cellulosic single ply or multi-ply paperboard, comprising ozonated medicinal cannabis non-hemp hurd fiber from the ozonated medicinal cannabis non-hemp hurd fiber pulp of claim 1 as the only cellulosic fiber in the cellulosic single ply or multi-ply paperboard.

10. An absorbent paper product, comprising ozonated medicinal cannabis non-hemp hurd fiber from the ozonated medicinal cannabis non-hemp hurd fiber pulp of claim 1 as the only cellulosic fiber in the absorbent paper product.

11. An ink receptive paper, comprising ozonated medicinal cannabis non-hemp hurd fiber from the ozonated medicinal cannabis non-hemp hurd fiber pulp of claim 1 as the only cellulosic fiber in the ink receptive paper.

12. An ozonated medicinal cannabis non-hemp hurd fiber pulp from alkaline-treated and ozone-treated hurd from cannabis grown at a density lower than used for growing hemp, the lower density promoting branching, flowering and bud formation, and a lower ratio of bast to hurd than cannabis grown for hemp, wherein the hurd fiber pulp is substantially free of bast fiber and has a coarseness from about 0.195 to about 0.285 mg/m.

13. A molded pulp carton comprising 100 wt. % ozonated cannabis non-hemp hurd fiber from the ozonated medicinal cannabis non-hemp hurd fiber pulp of claim 12 as the cellulosic fiber.

14. The molded pulp carton of claim 13 that is an egg carton.

15. A cellulosic smoking paper, comprising ozonated cannabis non-hemp hurd fiber from the ozonated medicinal cannabis non-hemp hurd fiber pulp of claim 12 as the only cellulosic fiber in the cellulosic smoking paper.

16. A paper substrate comprising 100% by weight of ozonated medicinal cannabis non-hemp hurd fiber from-the ozonated medicinal cannabis non-hemp hurd fiber pulp of claim 12 as the only cellulosic fiber in the paper substrate, the paper substrate having an inner surface and an outer surface; and a moisture barrier layer comprising one or more energy-cured polymers positioned over the outer surface, wherein the packaging material has a water vapor transportation rate of about 500 $g/m^2$/day or less.

17. A cellulosic single ply or multi-ply paperboard, comprising ozonated medicinal cannabis non-hemp hurd fiber from the ozonated medicinal cannabis non-hemp hurd fiber pulp of claim 12 as the only cellulosic fiber in the cellulosic single ply or multi-ply paperboard.

18. An absorbent paper product, comprising ozonated medicinal cannabis non-hemp hurd fiber from the ozonated medicinal cannabis non-hemp hurd fiber pulp of claim 12 as the only cellulosic fiber in the absorbent paper product.

19. An ink receptive paper, comprising ozonated medicinal cannabis non-hemp hurd fiber from the ozonated medicinal cannabis non-hemp hurd fiber pulp of claim 12 as the only cellulosic fiber in the ink receptive paper.

* * * * *